United States Patent [19]

Hagiwara et al.

[11] Patent Number: 4,773,828

[45] Date of Patent: Sep. 27, 1988

[54] BLOWER

[75] Inventors: Ippei Hagiwara; Naoyuki Hara, both of Nakatsugawa, Japan

[73] Assignee: Mitsubishi Denki Kabushiki Kaisha, Tokyo, Japan

[21] Appl. No.: 69,063

[22] Filed: Jul. 2, 1987

[30] Foreign Application Priority Data

Jul. 18, 1986 [JP] Japan ..... 61-110121[U]

[51] Int. Cl.[4] ..... F04B 17/02

[52] U.S. Cl. ..... 417/354; 310/67 R; 310/71

[58] Field of Search ..... 417/352, 353, 354, 423 G, 417/423 T; 310/67 R, 71, 62, 63, DIG. 6, 68 R

[56] References Cited

U.S. PATENT DOCUMENTS 3,644,066 2/1972 Heab et al. ..... 417/354
3,700,358 10/1972 Papst et al. ..... 417/354
4,115,715 9/1978 Muller ..... 310/68 B
4,558,245 12/1985 Glasaver ..... 310/67 R
4,629,919 12/1986 Merkle ..... 310/67 R X
4,636,669 1/1987 Plunkett et al. ..... 310/67 R X

*Primary Examiner*—Leonard E. Smith
*Assistant Examiner*—Eugene L. Szczecina, Jr.
*Attorney, Agent, or Firm*—Armstrong, Nikaido, Marmelstein & Kubovcik

[57] ABSTRACT

A blower comprising a frame formed with an air duct, a shaft support member provided at a substantially central portion of the air duct and mounted through mount legs to the frame, a bearing mounted to the shaft support member, a stator mounted to the shaft support member, a rotating shaft rotatably engaged with the bearing, a rotor fixed to the rotating shaft and having a magnet opposed to an outer circumference of the stator, a printed circuit board electrically connected to the stator, lead wires connected to the printed circuit board, and a connecting portion for connecting the lead wires with the printed circuit board, the connecting portion being located outside of the frame.

1 Claim, 3 Drawing Sheets

BLOWER

BACKGROUND OF THE INVENTION

The present invention relates to a blower for cooling an OA (office automation) equipment or the like, and more particularly to an improved connection of lead wires to be connected to the blower.

FIGS. 5 and 6 are rear and side views, respectively, of a conventional blower as disclosed in Japanese Utility Model Laid-Open Publication No. 58-40595, for example, and FIG. 7 is a side view of a motor stator in a conventional blower as disclosed in Japanese Utility Model Laid-Open Publication No. 57-58948, for example. In the drawings, the blower includes a frame 1 having an air duct 2, a shaft support member 3 having mount legs 4 mounted on the rear surface of the frame 1, to which an electric motor (not shown) including a stator 5 and so on is mounted. An impeller 6 is provided in the air duct 2, and is rotatably mounted on a rotating shaft (not shown) which is rotatably supported to the shaft support member 3. A printed circuit board 7 is electrically connected to the stator 5, and is fixed to the shaft support member 3. The printed circuit board is for accommodating circuit elements for driving the motor. Lead wires 8 are connected by welding to the printed circuit board 7, and are drawn to the outside of the frame 1 through one of the mount legs 4. A connecting portion between the lead wires 8 and the printed circuit board 7 is provided in the shaft support member 3.

In operation, the impeller 6 is rotated by supplying a current through the lead wires 8 to the motor to thereby operate the blower. In assembling the motor, the lead wires 8 are connected by welding to the printed circuit board 7, and are covered with the shaft support member 3. Then, the lead wires 8 are drawn out through the mount leg 4 to the outside of the frame.

In the coventional blower as mentioned above, after the lead wires 8 are welded to the printed circuit board 7, they are drawn out from the rear surface of the shaft support member 3. Accordingly, in case of changing a length of the lead wires 8, for example, changing a kind of the OA equipment to be installed, the blower must be dismantled so as to replace the read wires 8, or it must be replaced by another blower. Further, a manufacturer must change the length of the lead wires 8 according to the kind of the equipment, thus reducing workability.

SUMMARY OF THE INVENTION

It is an object of the present invention to provide a blower which permits the lead wires to be connected to the printed circuit board on the outside of the frame at the end of assembly process.

It is another object of the present invention to provide a blower which can be assembled in a standardized manner.

It is a further object of the present invention to provide a blower which permits the lead wires to be easily replaced.

According to the present invention, there is provided a blower comprising a frame formed with an air duct, a shaft support member provided at a substantially central portion of the air duct and mounted through mount legs to the frame, a bearing mounted to the shaft support member, a stator mounted to the shaft support member, a rotating shaft rotatably engaged with the bearing, a rotor fixed to the rotating shaft and having a magnet opposed to an outer circumference of the stator, a printed circuit board electrically connected to the stator, lead wires connected to the printed circuit board, and a connecting portion for connecting the lead wires. with the printed circuit board, the connecting portion being located outside the frame.

Other objects and features of the invention will be more fully understood from the following detailed description and appended claims when taken with the accompaning drawings.

DETAILED DESCRIPTION OF THE PREFERRED EMBODIMENT

Figure 1:
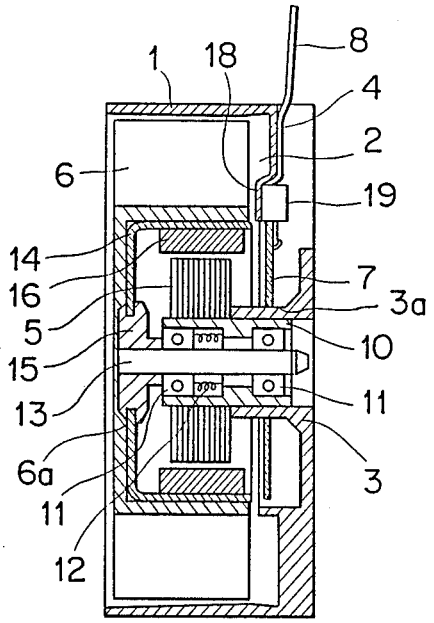
FIG. 1 is a sectional view of a preferred embodiment of the present invention.
Figure 2:
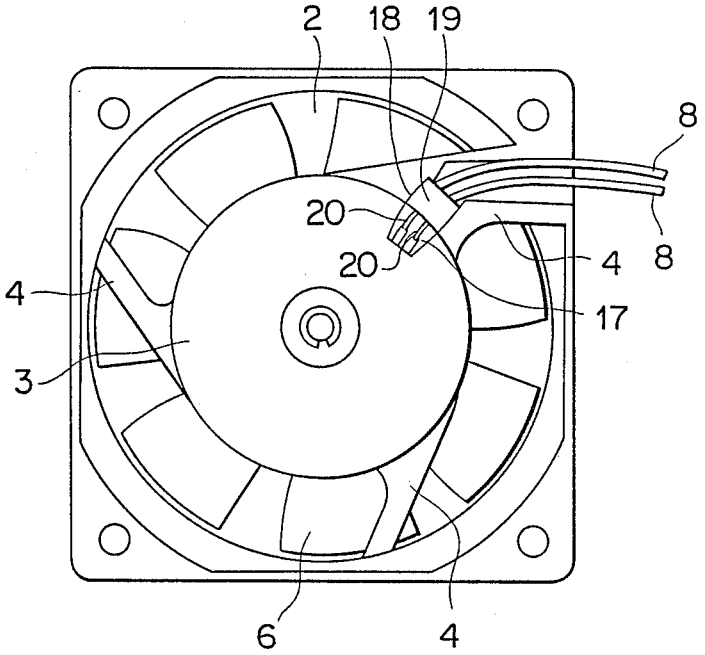
FIG. 2 is a rear view of the preferred embodiment.
Figure 3:
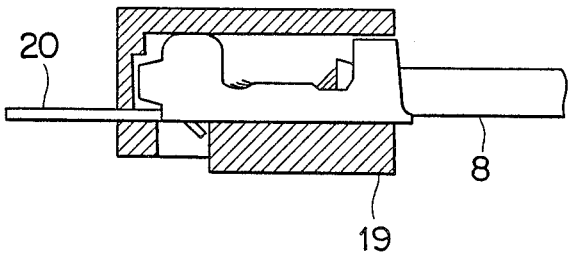
FIG. 3 is a sectional view of aconnecting portion between a connector and a printed circuit board.
Figure 4:
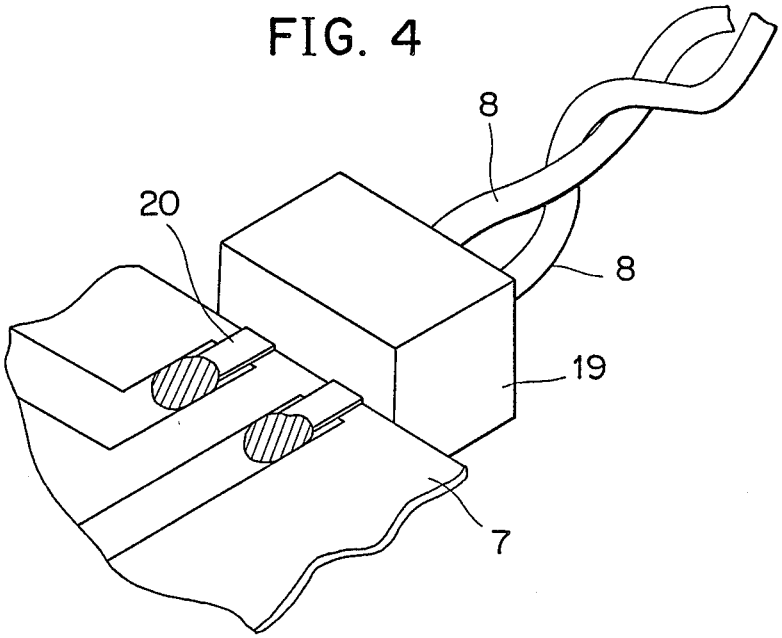
FIG. 4 is a perspective view of the connecting portion between the connector and the printed circuit board.
Figure 5:
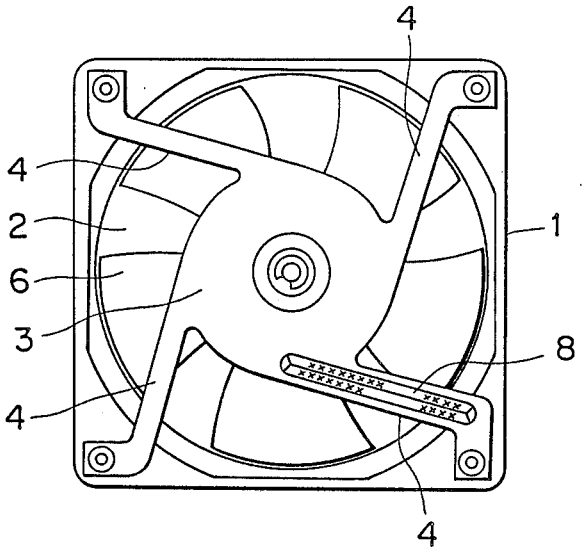
FIG. 5 Prior art
FIG. 5 is a rear view of the conventional blower.
Figure 6:
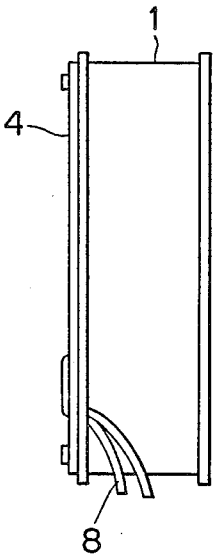
FIG. 6 Prior art
FIG. 6 is a side view of FIG. 5.
Figure 7:
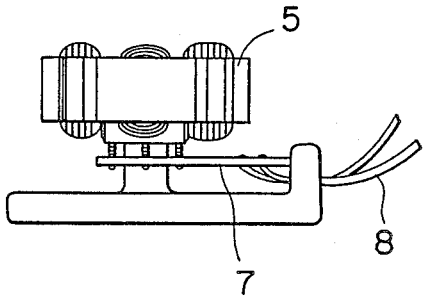
FIG. 7 Prior art
FIG. 7 is a side view showing the connection between the lead wires and the printed circuit board.

Referring to FIGS. 1 to 4 wherein the same or corresponding parts as in FIGS. 5 to 7 are designated by the same reference numerals. A cylinder 10 is engaged with a cylindrical portion 3*a* of the shaft support member 3. A stator 5 is mounted on the outer circumference of the cylinder 10. A pair of bearings 11 are provided in the cylinder 10, one of which being urged by a compressed spring 12. A rotating shaft 13 is rotatably supported by the bearings 11. A rotor 14 is fixed through a retainer 15 to the rotating shaft 13. The rotor 14 has a magnet 16 opposed to the outer circumferemce of the stator 5. The rotor 14 is engaged with a boss 6*a* of the impeller 6. A cut-away portion 17 is formed on the back surface of the shaft support member 3 so that a connecting portion between the lead wires 8 and the printed circuit board 7 may be exposed at the outside of the frame 1. A recess 18 is formed at the mount leg 4, and a connector 19 is provided to be engaged with the recess 18. The lead wires 8 are inserted into one end of the connector 19, and are fixed thereto, while a pair of pins 20 are provided at the other end of the connector 19. The pins 20 are electrically connected to the lead wires 8, and are welded to the printed circuit board 7.

In operation, when a current is supplied through the lead wires 8 to the stator 5, an electromagnetic force is generated to rotate the rotor 14 by a magnetic operation between the stator 5 and the magnet 16. In association with this, the impeller 6 is rotated to blow the air in an axial direction of the rotating shaft 13. On the other hand, in assembling the blower, the bearings 11 and the stator 5, etc. are installed to the frame 1. Then, the rotor 14 and the impeller 6 with the rotating shaft 13 are engaged with the bearings 11. Thus, the body of the blower is completely assembled. Then, the connector 19 is engaged with the recess 18 from the back side of the body of the blower. The pins 20 are welded to the printed circuit board 7 to be thereby connected to the lead wires 8. Then, the connecting portion between the lead wires 8 and the printed circuit board 7 is covered with an insulator member. Thus, all the assembly operation is ended. In this way, after the body of the blower is assembled, the lead wires are connected to the printed circuit board. Accordingly, the body of the blower may be standardized and therefore adapted to various kinds of OA equipments by connecting the lead wires 8 after completion of assembling of the body. Further, the lead wires 8 may be easily replaced.

Although the lead wires 8 are fixed to the connector 9, and the pins 20 of the connector 9 are welded to the printed circuit board 7 in the afore-mentioned preferred embodiment, the lead wires 8 may be directly welded to the printed circuit board 7.

While the invention has been described with reference to specific embodiments, the description is illustrative and and is not to be construed as limiting the scope of the invention. Various modifications and changes may occur to those skilled in the art without departing from the spirit and scope of the invention as defined by the appended claims.

What is claimed is:

1. A blower comprising:

a frame defining a cross section of an air duct;

a shaft support member provided on mounting legs mounted to said frame, said shaft support member being positioned at a substantially central portion of said cross section;

a bearing mounted on said shaft support;

a stator mounted to said shaft support;

a rotating shaft rotatably engaged with said bearing which its rotating axis positioned normal to said cross section;

a rotor secured to said rotating shaft, said rotor having magnets opposing to the outer circumference of said stator;

a printed circuit board which provides driving power for said stator, the output of said printed circuit board being electrically connected to said stator, a connector having lead wires for attachment to a power source and connecting pins for electrical connection with said printed circuit board, a portion of said shaft support member being cut-away to expose a connecting position of said printed circuit board; and a recess provided on one of said mounting legs adjacent said cut-away portion of said shaft support member, said recess being adapted to receive said connector in fitting engagement with said connector pins in contact with said printed circuit board in said cutaway portion of said shaft support member, whereby said connecting pins are exposed and positioned to be welded to said connecting portion of said printed circuit board.

* * * * *